US007506946B2

(12) United States Patent
Tsuboi et al.

(10) Patent No.: US 7,506,946 B2
(45) Date of Patent: Mar. 24, 2009

(54) APPARATUS AND METHOD FOR INK JET PRINTING

(75) Inventors: Hitoshi Tsuboi, Kawasaki (JP); Noribumi Koitabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 154 days.

(21) Appl. No.: 11/617,074

(22) Filed: Dec. 28, 2006

(65) Prior Publication Data

US 2007/0165068 A1 Jul. 19, 2007

(30) Foreign Application Priority Data

Dec. 28, 2005 (JP) ..... 2005-380068

(51) Int. Cl.
*B41J 29/38* (2006.01)

(52) U.S. Cl. ..... 347/13; 347/42

(58) Field of Classification Search ..... 347/13, 347/42, 49, 14, 15

See application file for complete search history.

(56) References Cited

U.S. PATENT DOCUMENTS 6,206,502 B1 * 3/2001 Kato et al. ..... 347/41
6,874,864 B1 4/2005 Maeda et al.
2008/0049057 A1 2/2008 Ochiai et al.

FOREIGN PATENT DOCUMENTS

JP 2002-96455 4/2002

* cited by examiner

*Primary Examiner*—Lamson D Nguyen
(74) *Attorney, Agent, or Firm*—Fitzpatrick, Cella, Harper & Scinto

(57) ABSTRACT

An apparatus and method for ink jet printing can reduce density unevenness caused by an end deviation condition associated with ink droplets ejected from a print head, regardless of gray scale of a printed image. The present invention thus sets the print duty for a nozzle located at an end of a nozzle array formed in a print head on the basis of the end deviation amount of a position impacted by an ink droplet ejected from the end of the nozzle array.

12 Claims, 17 Drawing Sheets

APPARATUS AND METHOD FOR INK JET PRINTING

BACKGROUND OF THE INVENTION

1. Field of the Invention

The present invention relates to an apparatus and method for ink jet printing which executes printing by executing a scanning relative to a print medium using a print head, the print head having a nozzle array in which a plurality of ink ejecting nozzles are disposed.

2. Description of the Related Art

Various forms of printing apparatuses have been proposed or implemented which execute printing on print media such as paper or OHP sheets; these printing apparatuses are classified by a printing scheme for a print head. Print heads are based on a wire dot scheme, a thermal scheme, a thermal transfer scheme, or an ink jet scheme. Among these printing apparatuses, ink jet printing apparatuses have been gathering much attention; the ink jet printing apparatus uses a print head based on the ink jet scheme to jet ink directly onto print media, and thus requires reduced running costs and is very silent.

The ink jet printing apparatuses are roughly classified into a full line type and a serial type.

The full line type ink jet printing apparatus uses a long print head having a length larger than the maximum width of print media used. The full line type ink jet printing apparatus continuously conveys a print medium to form a predetermined image on the print medium. The full line type ink jet printing apparatus is thus suitable for high speed printing.

The serial type ink jet printing apparatus forms an image by repeating a main scan that moves a relatively short print head to form an image of a width corresponding to the length of the print head and a sub-scan that moves the print medium in a direction crossing a moving direction of the print head by a predetermined amount.

For these ink jet printing apparatuses, efforts have been made to further reduce the size of ink droplets ejected from nozzles and to increase the density of the nozzles, in order to allow the formation of high quality images of increased resolutions and reduced granular appearances. A print head has been developed which has a high density of 1,200 dpi and which ejects small droplets each of 4 pl. A printing operation with such a high density print head causes a landing position of droplets ejected from nozzles in the print head which are located close to its end, to be deviated toward the center of the print head (end deviation condition). The end deviation condition has not frequently occurred in printing apparatuses that eject larger droplets at a lower density.

With a print head of an increased density, the end deviation condition occurs both in the full line type ink jet printing apparatus and in the serial type ink jet printing apparatus.

In the manufacture of long print heads such as those used in the full line type ink jet printing apparatus, it is technically and economically difficult to densely arrange a large number of nozzles in a single substrate in a line. The full line type ink jet printing apparatus commonly uses what is called a long connecting head formed by connecting together a plurality of short chips having densely arranged relatively short nozzle arrays so that the chips are staggered.

However, in this connecting head, the end deviation occurs in each chip, making the density of a formed image uneven. In common connecting heads, nozzles are disposed so that the spacing between terminal nozzles in two adjacent chips is the same as that between two adjacent nozzles within the same chip (the latter is hereinafter also referred to as a nozzle pitch).

In this case, the spacing between dots formed on a print medium by ink droplets ejected from the terminal nozzles in the adjacent chips is larger than that between dots formed by droplets ejected from two adjacent nozzles located close to a central part of the same chip. As a result, striped low-density portions (white stripes) are formed in the obtained image at intervals corresponding to the width of each chip. These white stripes degrade image quality.

Thus, a configuration has been proposed in which the chips are staggered and in which assuming the maximum deviation amount of ink droplets ejected from the ends of the chips, the ends of the adjacent chips are overlapped each other in the arranging direction. This configuration prevents possible white stripes even if end deviation occurs in droplets ejected from the ends of the adjacent chips because the ends of the adjacent chips are overlapped each other.

On the other hand, the serial type ink jet printing apparatus uses two printing schemes, one-pass printing and multipass printing. The one-pass printing is a scheme that completes an image in each scan area by one main scan of the print head. The one-pass printing is thus often used as a printing scheme that meets the recent demand for high-speed printing. However, images completed by the respective scans are sequentially joined together in the conveying direction of the print medium. Thus, with the one-pass printing, the end deviation condition results in uneven density portions (white stripes) at the connecting portions between images formed by the respective scans.

In contrast, the multipass printing completes an image on a same print area by executing a plurality of printing scans while changing which is used by the print head. The multipass printing can thus reduce possible density unevenness in the images. Further, a multipass printing scheme has been proposed which reduces the frequency with which the ejection nozzles at the end of the print head are used, while increasing the frequency with which the ejection nozzles in the central part of the head are used, to reduce the adverse effects of the end deviation condition, thus providing high quality images (see Japanese Patent Laid-Open No. 2002-96455).

Furthermore, to reduce density variations and density unevenness in the ink jet printing apparatus, following methods (1) and (2) have been proposed which stabilizes ejection speed and directionality (landing accuracy) as well as ejection amount per dot [pl/dot].

(1) Method for Controlling Ejection Amount

This is a method for divided pulse width modulation (method for PWM control) described in Japanese Patent Application No. 3-4713 proposed by the applicants. According to this method for divided pulse width modulation, a heat pulse that allows ink droplets to be ejected is composed of a pre-pulse that controls the temperature of the print head and a main pulse that allows ink droplets to be ejected. The pulse width of the pre-pulse is varied depending on the temperature of the print head. This makes it possible to inhibit a variation in ejection amount caused by a variation in temperature.

(2) Method for Correcting Density Unevenness

This method for correcting density unevenness uses the print head to print a test pattern at a fixed density and then reads the density unevenness of the test pattern. Then, on the basis of the read density unevenness, density signals for the nozzles are corrected. This is called a head shading method (HS method).

With the full-line type ink jet printing apparatus, having the long print head in which the ends of the adjacent chips overlap each other, it is possible to reduce possible white strips at the connecting portions between the chips. However, low-print-rate printing executed by each chip reduces the end deviation amount, possibly making the dot spacing smaller than the appropriate one, in contrast to high-print-rate printing. In this case, striped high-density portions (black stripes) having a printing density higher than that expressed by image data are printed in an image formed on the print medium. This degrades image quality. Further, the full line type ink jet printing apparatus completes an image onto the print medium by a single scan using the long print head. This prevents the division of one same scan area on the print medium into a plurality of portions for printing and a reduction in the frequency with which the ejection nozzles at the end of the print head are used, which are enabled by the serial type ink jet printing apparatus. It is thus difficult for the full line type ink jet printing apparatus to reduce density unevenness caused by the end deviation condition in the chips.

On the other hand, for the one-pass printing, the serial type ink jet printing apparatus also requires that the ends of the print areas printed by the print head overlap each other in order to avoid possible white stripes caused by a possible end deviation condition at the ends of the print ends. However, in this case, high-density portions (black stripes) having a printing density higher than that set by image data occur at the connecting portions between images formed by the respective scans. This degrades image quality.

Further, the technique disclosed in Japanese Patent Application No. 3-4713 controls the ejection amount of the print head to an average value to make it possible to eliminate a variation in density caused by a variation in temperature within a page or among pages. However, this technique cannot correct a variation in ejection amount among the nozzles of the print head. This prevents the elimination of the density unevenness within each nozzle array in the print head. In particular, the application of this technique to the serial type ink jet printing apparatus disadvantageously results in density unevenness at each connecting portion between images formed by the respective scans.

Moreover, the HS method in (2) prints a pattern of a fixed density (prints the pattern with the nozzles set at a predetermined print rate), then reads the printed pattern, and on the basis of the reading result, reads a correction value from a correction table for the fixed density. Then, on the basis of the read correction value, the density is corrected for the nozzles. This makes it possible to reduce the density unevenness near the fixed density. However, during an actual printing operation, the print rate of the nozzles varies every moment. Thus, the correction based on a pattern of a fixed density as described above does not enable the density unevenness to be sufficiently corrected. For example, a rapidly varying print duty or too high or low a print duty cannot be dealt with only by one correction table corresponding to a pattern formed at a fixed density. Consequently, the HS method requires a large number of correction tables that correct the density unevenness over the entire density area covering all densities from low density to high density. Providing these correction tables is difficult.

Thus, none of the conventional techniques sufficiently eliminate possible density unevenness on images. In particular, when pictorial color images or the like are printed on the basis of image signals (multivalue data) input by an external instrument via a read device or the like, density unevenness may occur. For example, if a full color image composed of four colors, cyan, magenta, yellow, and black, is printed by the serial type ink jet printing apparatus using a small number of passes, density unevenness may occur at the connecting portions between images printed by the respective scans. With the full line type ink jet printing apparatus, density unevenness may occur frequently at the connecting portions between images formed by the respective chips. If blue sky, sky at sunset, or human skin, which has a uniform tone, is printed, color balance is partly disrupted, changing the hue. The change in hue may result in color unevenness in images or degraded image color reproducibility (increased color difference). This degrades image quality. Density unevenness may also occur in monochromatic images in black, red, blue, green, or the like. Further, printing operations based on the multipass scheme is effective on image quality. However, this increases the number of scans executed by the print head, significantly reducing print speed.

SUMMARY OF THE INVENTION

An object of the present invention is to provide an apparatus and method for ink jet printing which can reduce density unevenness caused by an end deviation condition associated with ink droplets ejected from a print head, regardless of gray scale of a printed image.

To attain this object, the present invention has a configuration described below.

A first aspect of the present invention is an ink jet printing apparatus which executes printing by executing a scanning a print head relative to a print medium using a print head, the print head having a nozzle array in which a plurality of ink ejecting nozzles are arranged, the apparatus comprising print duty setting means for setting a print duty for a nozzle located at an end of the nozzle array on the basis of an end deviation amount corresponding to an error in a landing position of an ink droplet ejected from the end of the nozzle array.

A second aspect of the present invention is a method for ink jet printing which executes printing by scanning a print head relative to a print medium, the print head having a nozzle array in which a plurality of ink ejecting nozzles are disposed, wherein a print duty for nozzles located at an end of the nozzle array is set the basis of an end deviation amount that is an error in a landing position of an ink droplet ejected from the end of the nozzle array.

According to the present invention, even if end deviation occurs at the end of the nozzle array, the print duty for the nozzle located at the end of the nozzle array is set on the basis of the amount of the end deviation. The present invention can thus reduce the density unevenness in images regardless of the end deviation amount.

Further features of the present invention will become apparent from the following description of exemplary embodiments (with reference to the attached drawing).

DESCRIPTION OF THE EMBODIMENTS

Embodiments of the present invention will be described below in detail with reference to the drawings.

First Embodiment

First, with reference to FIGS. 13 and 14, description will be given of an example of basic configuration of an ink jet printing apparatus applied to the embodiment of the present invention.

Figure 13:
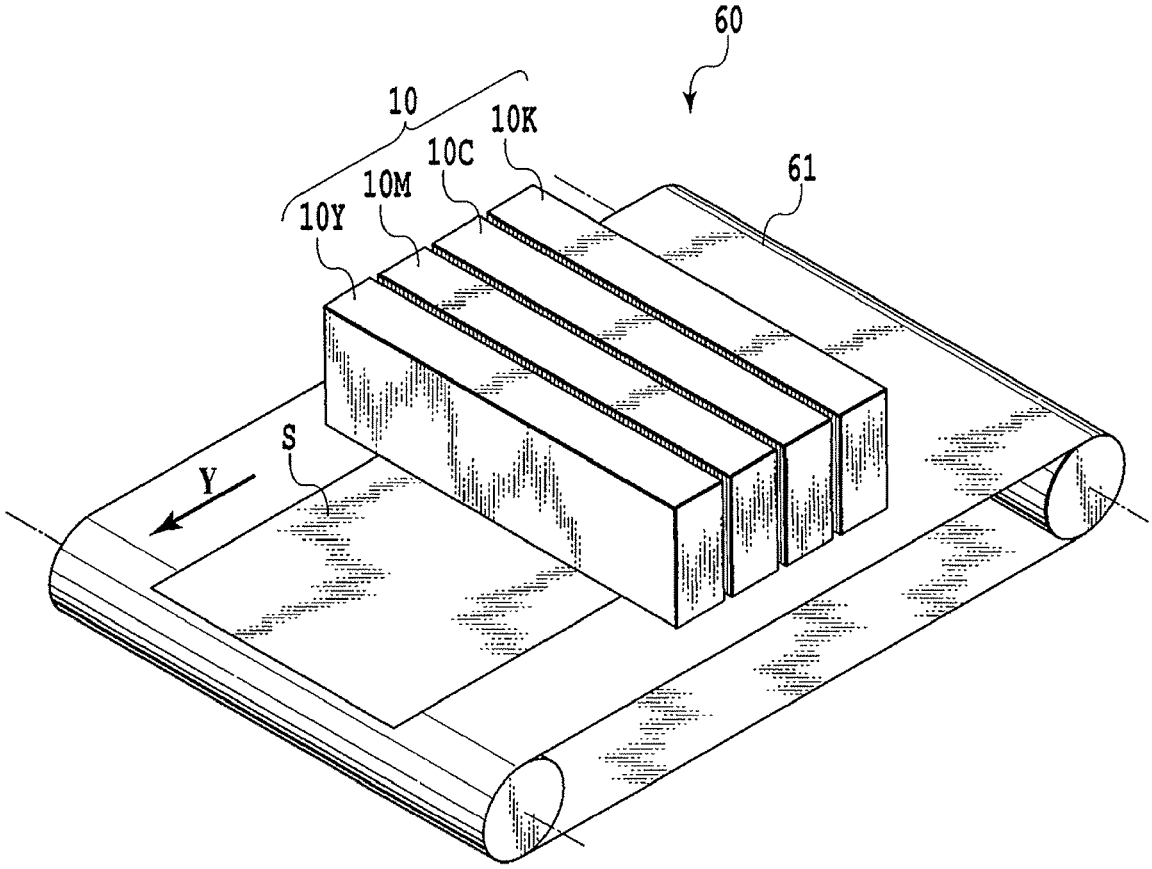
FIG. 13 is a schematic perspective view schematically showing an example of configuration of a mechanism section of a full line type ink jet printing apparatus applied to the first embodiment of the present invention.

FIG. 13 is a perspective view schematically showing an example of configuration of a mechanism section of a full line type ink jet printing apparatus applied to the embodiment of the present invention.

The full line type ink jet printing apparatus 60 in the present example prints an image on a print sheet S as a print medium by ejecting ink from nozzles in a print head 10 provided at a given position while conveying the print sheet S on a conveying belt 61. The long print head 10 extends over a width larger than that of print sheets S of an applicable maximum size. The print head 10 enables an image to be continuously printed by ejecting ink droplets onto the print sheet S being continuously conveyed. In the present example, the print head 10 includes a print head 10Y that ejects yellow ink, a print head 10M that ejects magenta ink, a print head 10C that ejects cyan ink, and a print head 10K that ejects black ink; the print heads 10Y, 10M, 10C, and 10K are arranged in parallel. Color images can be printed by ejecting ink droplets from these print heads 10.

The print head 10 may be based on any of various schemes for ejecting ink using electrothermal converters (heaters) or piezo elements. The print head 10 using electrothermal converters generates a bubble in ink in ink channels by heat generated by the electrothermal converters. Bubbling energy of the ink enables the ink itself to be ejected from ejection ports. In the preset invention, portions in which the ink channels including the ejection ports are formed are referred to as nozzles.

Figure 14:
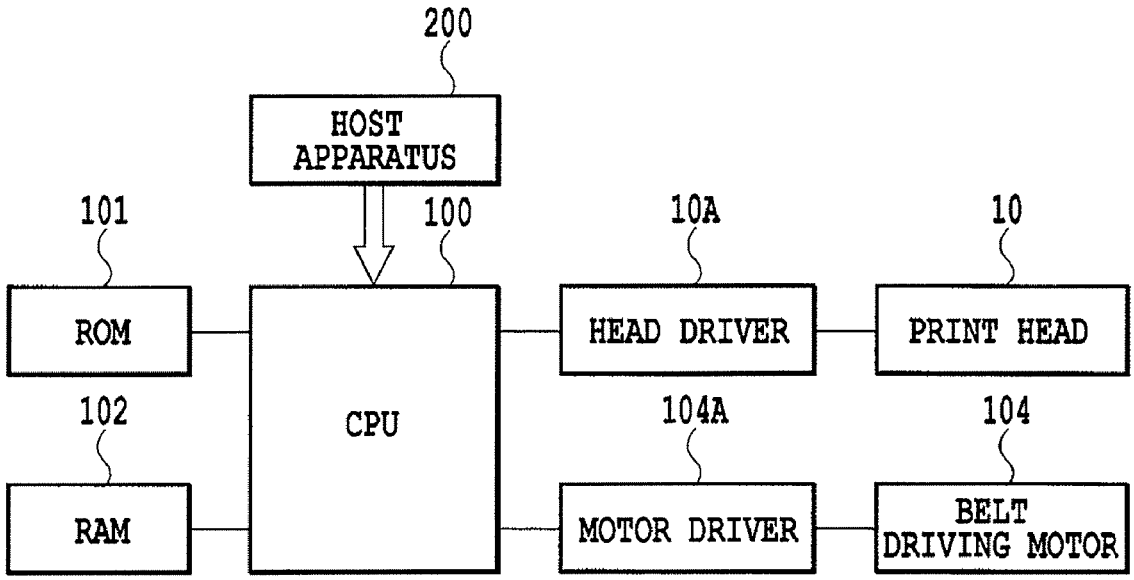
FIG. 14 is a block diagram schematically showing an example of configuration of a control system for the ink jet printing apparatus shown in FIG. 13.

FIG. 14 is a block diagram schematically showing an example of configuration of a control system for the ink jet printing apparatus shown in FIG. 13.

In FIG. 14, a CPU 100 executes a process of controlling the operation of the printing apparatus, a data process, and the like. A ROM 101 stores programs for the procedures of these processes and the like. A RAM 102 is used as a work area or the like in which the processes are executed. On the basis of original image data received from a host apparatus in the form of a personal computer or the like, the CPU 100 drives the print head 10 via a head driver 10A to eject ink from nozzles in the print head 10. For example, if the print head 10 ejects ink using electrothermal converters, the CPU 100 supplies the head driver 10A with drive data for the electrothermal converters and drive control signals (heat pulse signals). This allows the print head 10 to eject ink.

The CPU 100 also controls, via a motor driver 104A, a belt driving motor 104 that moves a conveying belt 61. The CPU 100 also controls the print head 10 via the head driver 10A. The CPU 100 further has an image processing function for controlling the number (print duty) of ink droplets in a predetermined unit area which are ejected from the print head 10, on the basis of the density in input image data, as described below. These functions of the CPU 100 may be provided in a host apparatus 200.

Now, with reference to FIG. 1, description will be given of the line head 10 used in the first embodiment and landing positions of ink droplets ejected from the line head 10. The long line head 10 is constructed by connecting head chips h1 and h2 together along a nozzle arranging direction (X direction) The head chips h1 and h2 have nozzle arrays N1 and N2, respectively, in which a plurality of ink ejecting nozzles are densely arranged at fixed intervals (reference nozzle intervals). The head chip h2 is placed offset from the head chip h1 in a Y direction so that its end overlaps an end of the head chip h1 in an X direction. The relative positions of the head chips h1 and h2 in the X direction are set so that when a reference position is located the reference nozzle interval away from the terminal nozzle in the head chip h1 in the X direction, the terminal nozzle in the head chip h2 is located as described below.

The terminal nozzle n11 in the head chip h2 is set at a position located a distance away from the reference position P, the distance being equal to the sum of possible maximum end deviation amounts $\alpha$ in the head chips h1 and h2. Here, since the head chips h1 and h2 have the same end deviation amount ($\alpha$), the distance between the terminal nozzle in the head chip h2 and the reference position P in the X direction is double ($2\alpha$) the possible end deviation amount at each end nozzle. In the first embodiment, a connecting portion OP1 between the head chips h1 and h2 is composed of the terminal nozzles n11 and n21 in the head chips.

Figure 3:
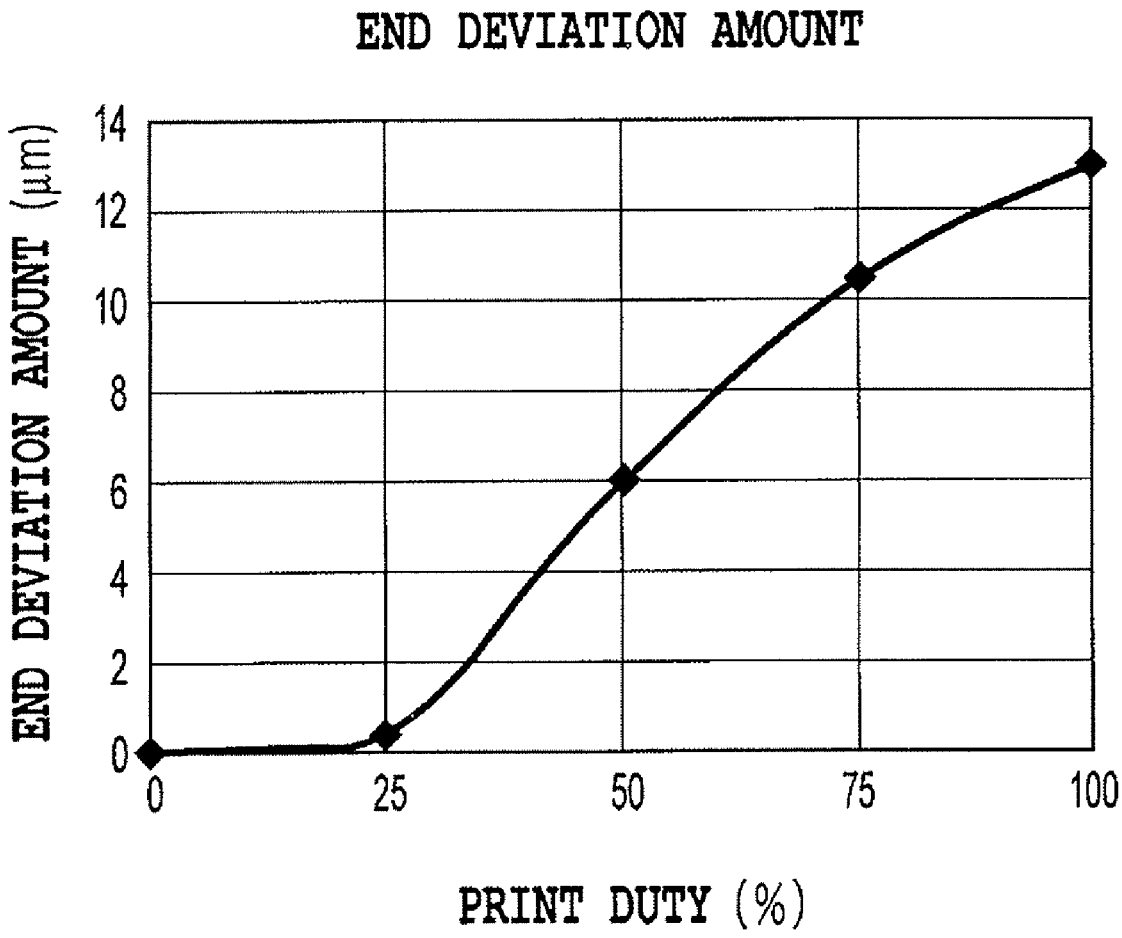
FIG. 3 is diagram showing the relationship between the amount of possible end deviation at the terminal nozzles in the print head shown in FIG. 1 and print duties set for respective nozzle arrays by original image data.

With reference to FIG. 3, possible end deviation amounts at the terminal nozzles n11 and n21 increase in keeping with print duties (set print duties) set for the nozzle arrays N1 and N2 in the nozzle chips h1 and h2 by the original image data. Consequently, for a 100% print duty corresponding to solid printing with ink droplets ejected from the nozzle arrays N1 and N2, the end deviation amount is at maximum. The end deviation amount decreases consistently with the print duties set for the nozzle arrays N1 and N2. The end deviation amount shown on the axis of ordinate in FIG. 3 indicates the possible end deviation amount at each of the terminal nozzle n11 and n21 (see FIG. 1) in the head chips h1 and h2. An ink droplet ejected from the terminal nozzle n11 or n21 in the head chip h1 or h2 deviates toward the center of the head chip h1 or h2. In this case, if the terminal nozzle n21 is at the reference position P, the distance between the centers of two dots formed by the respective terminal nozzle is double ($2\alpha$) the end deviation amount of a dot formed by an ink droplet ejected from one of the terminal nozzles. In the print head 10, shown in FIG. 1, the relative positions of the head chips h1 and h2 are set assuming the case where the distance ($2\alpha$) double the end deviation amount is the interval for one pixel corresponding to the nozzle interval in the head chips h1 and h2.

Figure 1:
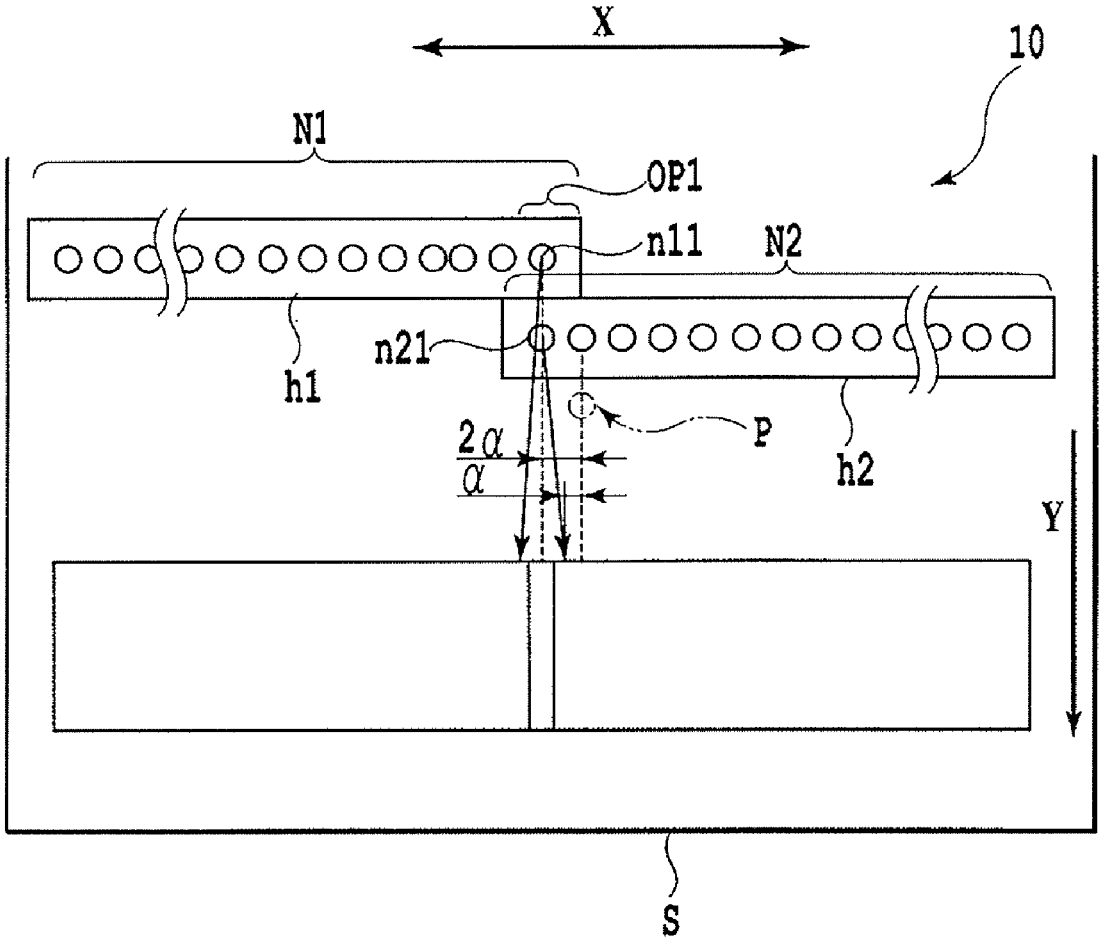
FIG. 1 is a diagram illustrating line heads used in a first embodiment of the present invention and landing positions of ink droplets ejected from line heads.
Figure 2:
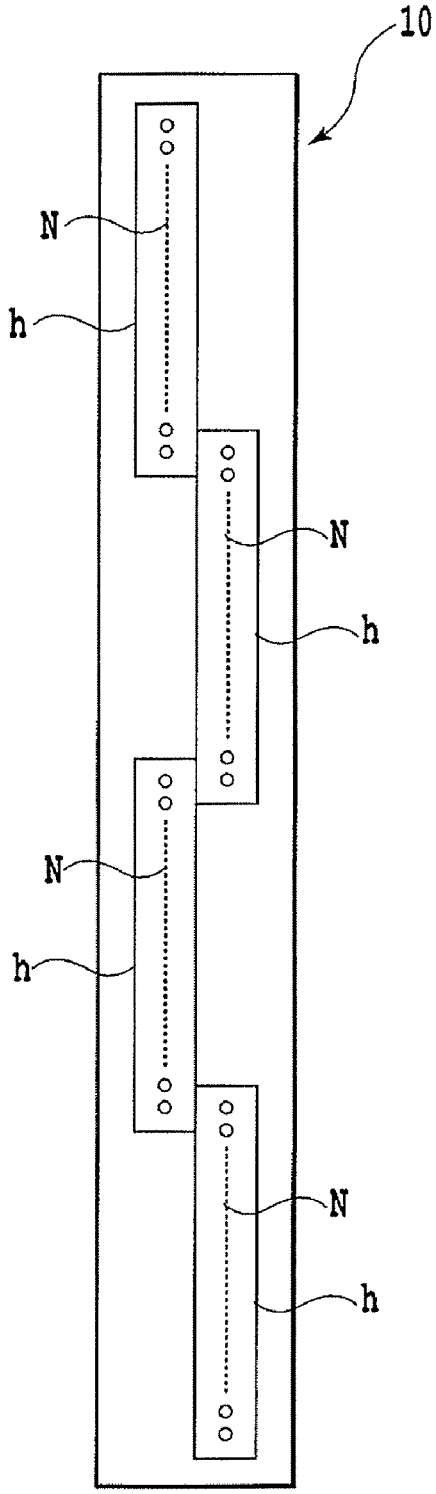
FIG. 2 is a diagram schematically showing a print head having at least three staggered head chips.

FIG. 1 shows only two head chips h1 and h2. However, to form a longer print head, at least three head chips h are desirably staggered as shown in FIG. 2. This reduces the entire width of the print head.

Even for the maximum print duty, resulting in the maximum end deviation amount, the print head configured as described above can form dots at appropriate intervals using the terminal nozzles n11 and n21. That is, the center distance (hereinafter referred to as an inter-dot distance) between dots formed by the terminal nozzles n11 and n21 is the same as the inter-dot distance between dots formed by two adjacent nozzles located where the end deviation condition will not occur. This reduces possible density unevenness at the connecting portion OP1 caused by a change in dot density (change in print duty). As a result, a favorable image quality can be obtained.

If a low print duty is set for the nozzle arrays N1 and N2, the end deviation amount decreases from the maximum value. This reduces the center distance between dots formed by the terminal nozzles n11 and n21 below the inter-dot distance between dots formed by nozzles located at a position other than the connecting portion OP1. Consequently, a printing operation with the print duty set for the original image data unchanged increases the dot density to make the optical density of an actually printed image higher than the density (hereinafter referred to as the original image density) expressed by the original image data. In contrast, the optical density of an image printed by nozzles in an area in which the end deviation does not occur is formed on the basis of the original image density. This causes high density portions resulting from a decrease in end deviation amount to appear in an image as density unevenness (black stripes).

Figure 4:
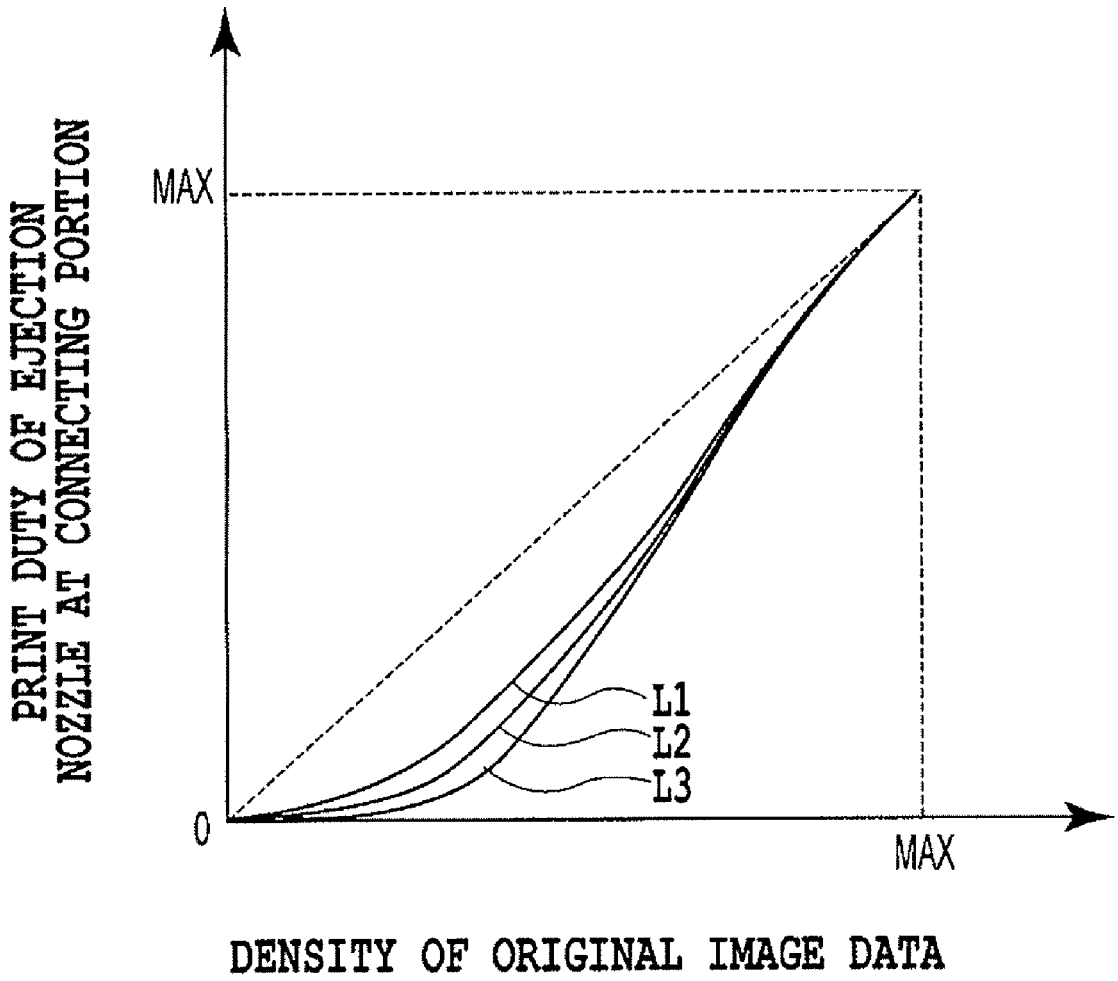
FIG. 4 is a diagram showing the relationship between the print duty for the print head shown in FIG. 1 and the density in the original image data.

Thus, in the first embodiment, the density of dots actually formed on the print sheet S by the terminal nozzles n11 and n21, located at the connecting portion OP1, decreases more according to lowing of the print duty set by the original image data. This enables a reduction in possible density unevenness as described above. In this case, the print duty which determines the number of ink droplets actually ejected onto the print sheet S is controlled with respect to the density set on the basis of the original image data in accordance with a curve shown in FIG. 4.

That is, the relationship between the print duties for nozzles located in an area other than the connecting portion OP1 and the original image data density is normally set to be linear as shown by a dashed line in FIG. 2. In contrast, the relationship between the print duties for the nozzles located at the connecting portion OP1 and the density determined by the original image data is set as shown by one of three solid lines L1, L2, and L3 in the figure. One of these solid lines is selected depending on the amount of ink droplets ejected from the terminal nozzles n11 and n21 as described below. As is apparent from the solid lines, the print duties for the nozzles located at the connecting portion OP1 are lower than those of the nozzles located in an area other than the connecting portion OP1. Thus, even if a printing operation is performed at a low print duty at which the end deviation condition does not occur easily, the density of an image formed on the print sheet is prevented from increasing. This enables a high quality image to be formed.

The first embodiment achieves a higher image quality by assuming a variation in the amount of ink droplets ejected from the terminal nozzles n11 and n21 at the connecting portion OP1.

That is, manufacturing variations or the like may vary the amount of ink droplets from the terminal nozzles in the head chips h1 and h2. A variation in the amount of ink droplets varies the density of an image formed on the print sheet S. Thus, in the first embodiment, the print density with respect to the original image data density is set to a value corresponding to the amount of ink droplets as shown by the three solid lines L1, L2, and L3 in FIG. 4.

L2 denotes the case where a standard amount of ink droplets are ejected from the terminal nozzles at the connecting portion. If the amount of ink droplets from the terminal nozzles n11 and n21 is smaller than the standard ink droplet amount, the amount of decrease in print duty is set to a smaller value as shown by the solid line L1. In contrast, if the amount of ink droplets from the terminal nozzles is larger than the standard ink droplet amount, the amount of decrease in print duty is set to a larger value as shown by the solid line L3.

Thus setting the amount of decrease in print duty with respect to the original image data density enables an image of an appropriate density based on the original image data density to be formed on the print sheet S.

Now, with reference to FIG. 5, description will be given of a method for image processing executed in the first embodiment.

Figure 5:
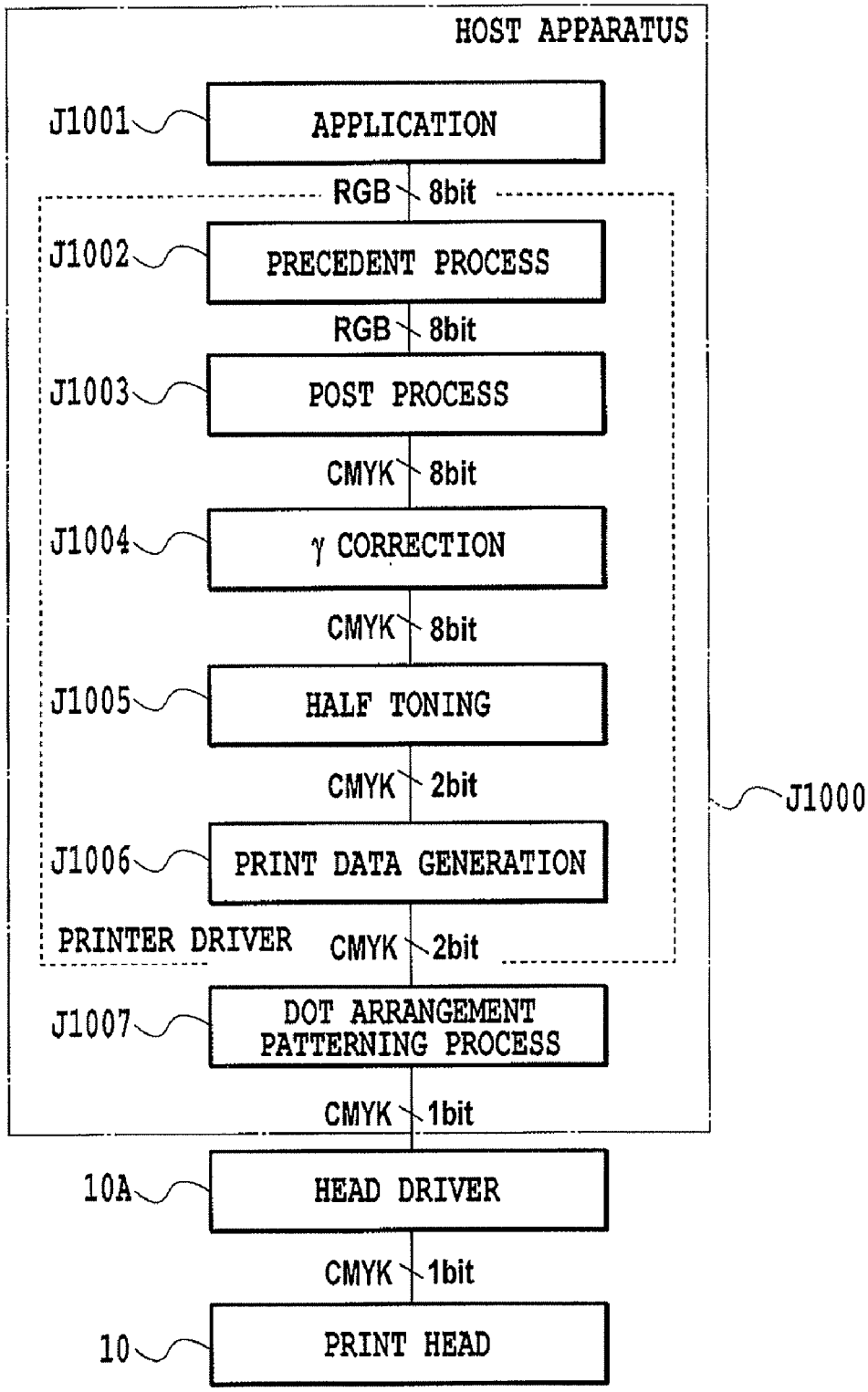
FIG. 5 is a block diagram showing a method for image processing executed according to the first embodiment of the present invention.

FIG. 5 is a block diagram showing the basic flow of an image data converting process in an ink jet printing system according to the present embodiment.

FIG. 5 is a block diagram showing the flow of the image data converting process, executed by an image processing section J1000 of the ink jet printing system according to the present embodiment. In the present embodiment, processes of the image processing section J1000, shown in FIG. 5, are performed by the control circuit having the CPU 100, ROM 101, and RAM 102, provided in the ink jet printing apparatus, or by the host apparatus 200.

Programs operating in the ink jet printing apparatus include an application and a printer driver. The application J0001 executes a process of creating image data that is printed by the printing apparatus. For actual printing, image data created by the application is passed to the printer driver.

The printer driver according to the present embodiment executes processes including a precedent process J0002, a post process J0003, $\gamma$ correction J0004, half toning J0005 that is multivalue quantization, and print data generation J0006. These processes will be described in brief. The precedent process J0002 executes mapping of gamut. This process executes a data conversion to map a gamut reproduced by image data R, G, and B conforming to the sRGB standard into a gamut reproduced by the printing apparatus. Specifically, data in which each of R, G, and B is expressed by 8 bits is converted into 8-bit data on each of R, G, and B having different contents using a three-dimensional LUT.

The post process J0003 executes a process of, on the basis of the data R, G, and B subjected to the gamut mapping, obtaining color separation data Y, M, C, and K corresponding to a combination of inks that reproduces colors expressed by the data R, G, and B. Like the former process, the latter process J0003 uses a three-dimensional LUT to execute interpolations.

The γ correction J0004 execute a gradation value conversion the color separation data obtained by the post process J0003 for each color. Specifically, the gradation value conversion is done by using a one-dimensional LUT corresponding to the gradation characteristic of each color ink of the printing apparatus so that the color separation data can be linearly matched to the gradation characteristic of the printing apparatus.

The half toning J0005 executes quantization to convert the each of the 8-bit color separation data Y, M, C, and K into 2-bit data. The present embodiment uses a multivalue error diffusion method or a dither method to convert 256-gradation 8-bit data into 3-gradation 2-bit data. This 2-bit data is an index indicating an arrangement pattern for a dot arrangement patterning process J1007 executed by the ink jet printing apparatus.

The final process executed by the printer driver, the print data generation process J0006, generates print data by adding print control information to print image data containing the 2-bit index data. The ink jet printing apparatus subsequently executes the dot arrangement patterning process J0007 on the input print data. The ink jet printing apparatus sends the processed data to the print head driver 10A to drive the print head 10.

Figure 6A:
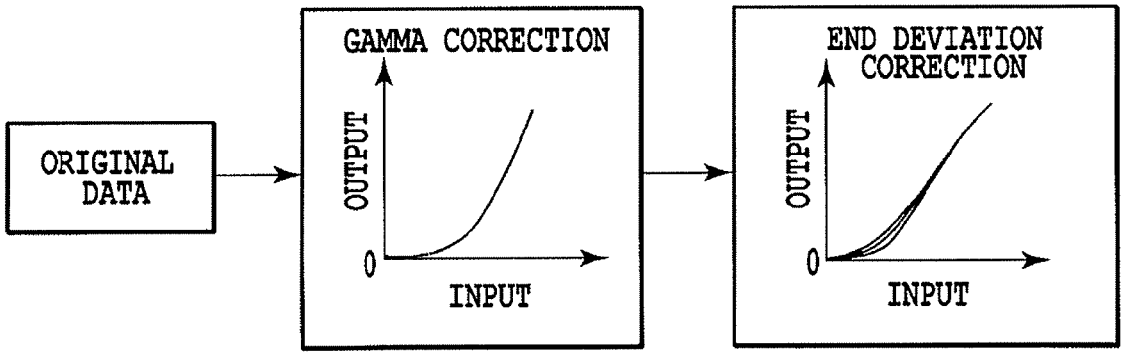
FIG. 6A is a diagram showing a gamma correction process and an end deviation correction process which are executed according to the first embodiment of the present invention.

In the above image processing, the first embodiment executes a gamma correction process on the basis of the amount of ink droplets as shown in FIG. 6A. The first embodiment further corrects the gamma-corrected print data for density unevenness resulting from end deviation (this operation is hereinafter referred to as an end deviation correction). Specifically, unless printing is executed at a high print duty with the maximum end deviation amount, dots formed by the nozzles located at the connecting portion OP1 between the nozzle chips h1 and h2 are thinned out. The end deviation correction process can basically be achieved by determining the difference between the end deviation amount at a print duty for 100% such as the one shown in FIG. 3 and the end deviation mount at a different print duty to reduce the value of the original image data density depending on the magnitude of the difference. However, the first embodiment further executes a correction process in accordance with characteristics such as the amount of ink droplets ejected from the nozzles located at the connecting portion OP1. That is, a larger ink droplet amount increases the amount of ink on the print medium while reducing the end deviation amount, in spite of the same ejection number. Thus, the original image data is reduced a lot to thin out more of the dots. For a smaller ink amount, the original image data is reduced fewer to thin out fewer of the dots. This process is executed by the gamma correction process J1004 in the image processing section J1000. This process enables the print duty at the connecting portion OP1 to be set to a more optimum value.

The end deviation correction process is executed by the half toning process shown in FIG. 5. That is, the half toning process J1005 according to the first embodiment multiplies the 8-bit image data, which enables input 256 gradations to be expressed, by a predetermined ratio to reduce the density value expressed by the original image data. This tend to reduce data expressing the formation of dots and included in binary data which are output as a result of the dot arrangement patterning process and which indicate whether or not to form dots. This in turn inhibits an increase in the density of an image formed by the nozzles located at the connecting portion OP1.

As described above, the first embodiment executes the end deviation correction after the gamma correction process based on the amount of ink droplets. This enables a reduction in possible density unevenness such as black or white stripes regardless of the density of the input image.

Second Embodiment

Now, a second embodiment of the present invention will be described.

Figure 6B:
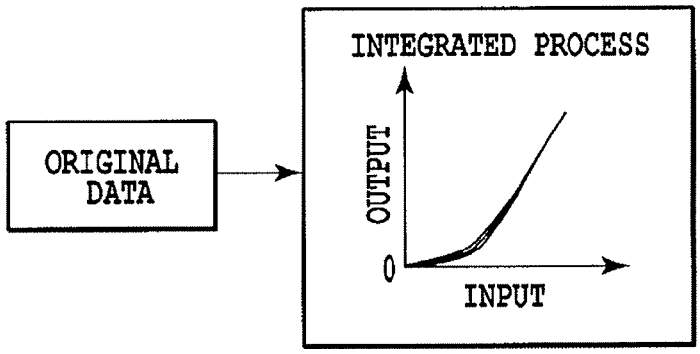
FIG. 6B is a diagram showing an integrated process executed according to a second embodiment of the present invention.

With ink jet printing apparatuses, ink droplets land on the print sheet S land on a rectangular enclosed pixel area virtually set on the print sheet S. At this time, the ink droplets landed on the print medium bleed and protrude from pixel area to form round dots. In this case, at a lower print duty, a smaller number of dots are placed on the print sheet S, allowing the optical density to be easily increased. However, at a higher print duty, adjacent dots overlap each other, suppressing an increase in optical density. To correct this, the gamma correction process is normally executed for the density value expressed by the original image data so as to reduce the density value of an image formed on the print sheet S. The second embodiment executes an integrated correction composed of this gamma correction integrated with the end deviation correction (see FIG. 6B).

Thus, compared to the end deviation correction executed on the gamma-corrected original data as is the case with the first embodiment, shown in FIG. 6A, the integrated correction enables the data processing to be simplified. The corrected image data is binarized and input to the head driver 10A.

In the description of the example for the first and second embodiment, the terminal nozzle n21 in the head chip h2 is located closer to the center of the head chip h1 than the reference position P by one pixel (reference nozzle interval). However, depending on the relationship between the maximum end deviation amount and the reference nozzle interval, the terminal nozzle n21 in the head chip h2 may be located closer to the center of the head chip h1 than the reference position P by a length shorter than the reference nozzle interval. For example, the terminal nozzle n21 in the head chip h2 may be located closer to the center of the head chip h1 than the reference position P by a length equal to half the reference nozzle interval.

Third Embodiment

Now, a third embodiment of the present embodiment will be described with reference to FIGS. 7 and 8.

In the description of the example for the first and second embodiments, the total distance (2α) corresponding to the maximum end deviation amounts of the terminal nozzles in the head chips h1 and h2 is equal to the distance between the terminal nozzle n21 in the head chip h2 and the reference position P. In contrast, in the print head 10 according to the third embodiment, as shown in FIG. 7, the head chip h2 is placed so that the distance T between the terminal nozzle n21 in the head chip h2 and the reference position P is more than double the maximum end deviation amount (α). In FIG. 7, OP2 denotes the connecting portion between the head chips h1 and h2.

This makes it possible to suppress a rapid change in the density of an image formed by the connecting portion OP2. Thus, an image formed by the connecting portion OP2 and images formed by other portions can be smoothly connected together. FIG. 7 shows an example of the connecting portion OP2 in which the head chips h1 and h2 are arranged so that four nozzles n11 to n14 located at an end of the head chip h1 are at the same positions as those of four nozzles n21 to n24 located at an end of the head chip h2 in the X direction. In the description below, the nozzle located at the terminal of the nozzle array is called the terminal nozzle. The other nozzles located in the connecting portion of each head chip are called end nozzles.

Also in the third embodiment, the end deviation amounts of the terminal nozzles n11 and n21 in the head chips h1 and h2 vary depending on the print duties set for the nozzle arrays N1 and N2 by the original image data as shown in FIG. 3. That is, the end deviation amount is maximized when the print duty is at the maximum. A decrease in print duty reduces the end deviation amount. The print duties for the nozzles located at the connecting portion OP2 between the head chips h1 and h2 are set so that the sum of print duties for a pair of nozzles from which ink droplets that land on the print sheet at the same position in the nozzle arranging direction (X direction) are ejected is equal to the original image data density. If no end deviation occurred, ink droplets ejected from the terminal nozzle n11 and end nozzle n24 would land on the print sheet S at the same position. Thus, the sum of the print duties set for the terminal nozzle n11 and end nozzle 24 is equal to the print duty set by the original image data.

Figure 7:
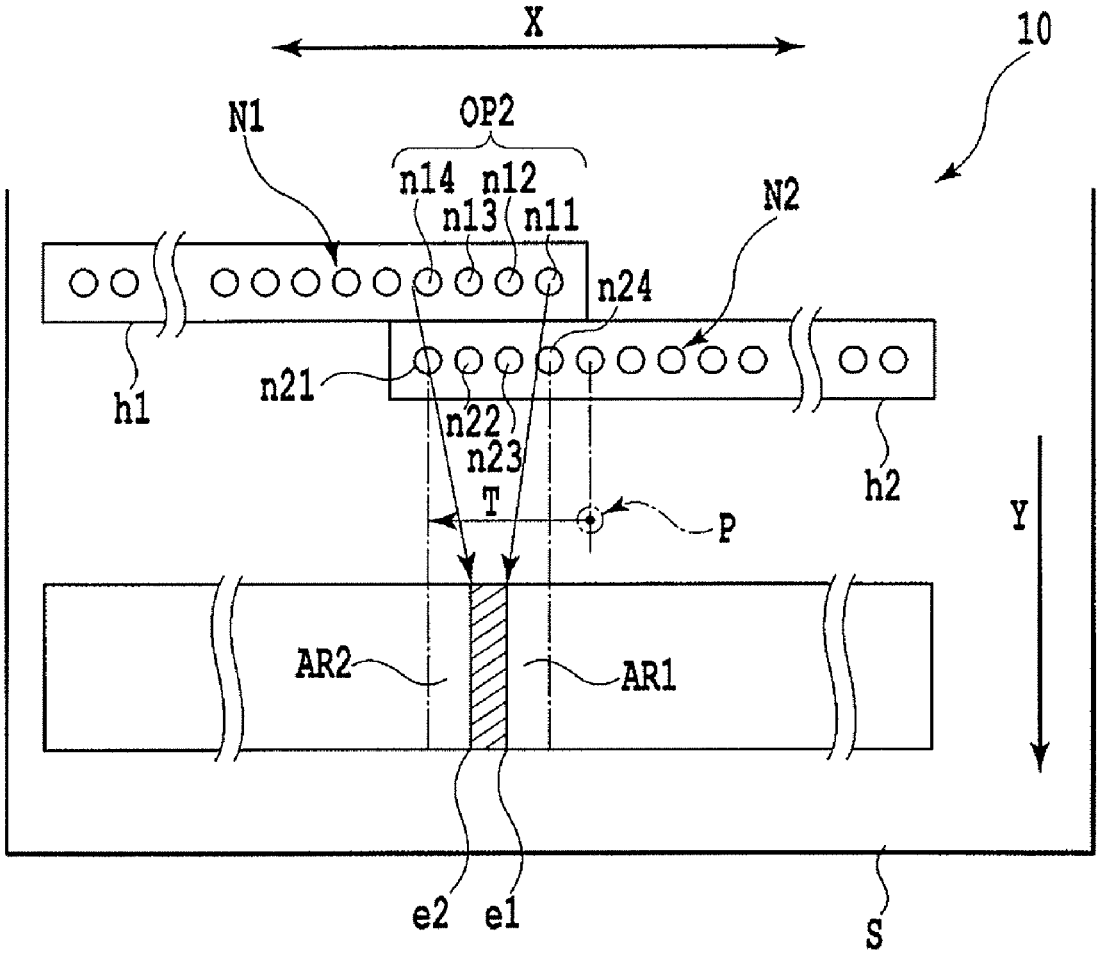
FIG. 7 is a diagram illustrating a print head used according to a third embodiment of the present invention and landing positions of ink droplets ejected from the print head.

As shown in FIG. 7, the maximum print duty, resulting in the maximum end deviation amount, minimizes the width of an area AR1 (overlapping area) in which ink droplets ejected from those nozzles in the head chip h1 and h2 that are located at the connecting portion OP2 overlap (or mix with) one another on the print sheet. A difference occurs in dot density between the overlapping area AR1 and another area AR2. This varies the density of an image formed by the nozzles located at the connecting portion OP2. A variation in density is a factor that causes density unevenness. On the other hand, the end deviation amount decreases in keeping with the print duties set for the nozzle arrays N1 and N2. Thus, the density of dots formed on the print sheet by ink droplets ejected from the nozzles located at the connecting portion OP2 gradually becomes uniform. The uniform dot density reduces the density unevenness of a printed image. In this case, the overlapping area AR1 is wider than in the case of the maximum print duty.

This inhibits the dot density from varying depending on the print duty. To achieve this, the third embodiment adjusts the print duties for the nozzles at the connecting portion OP2.

Figure 8:
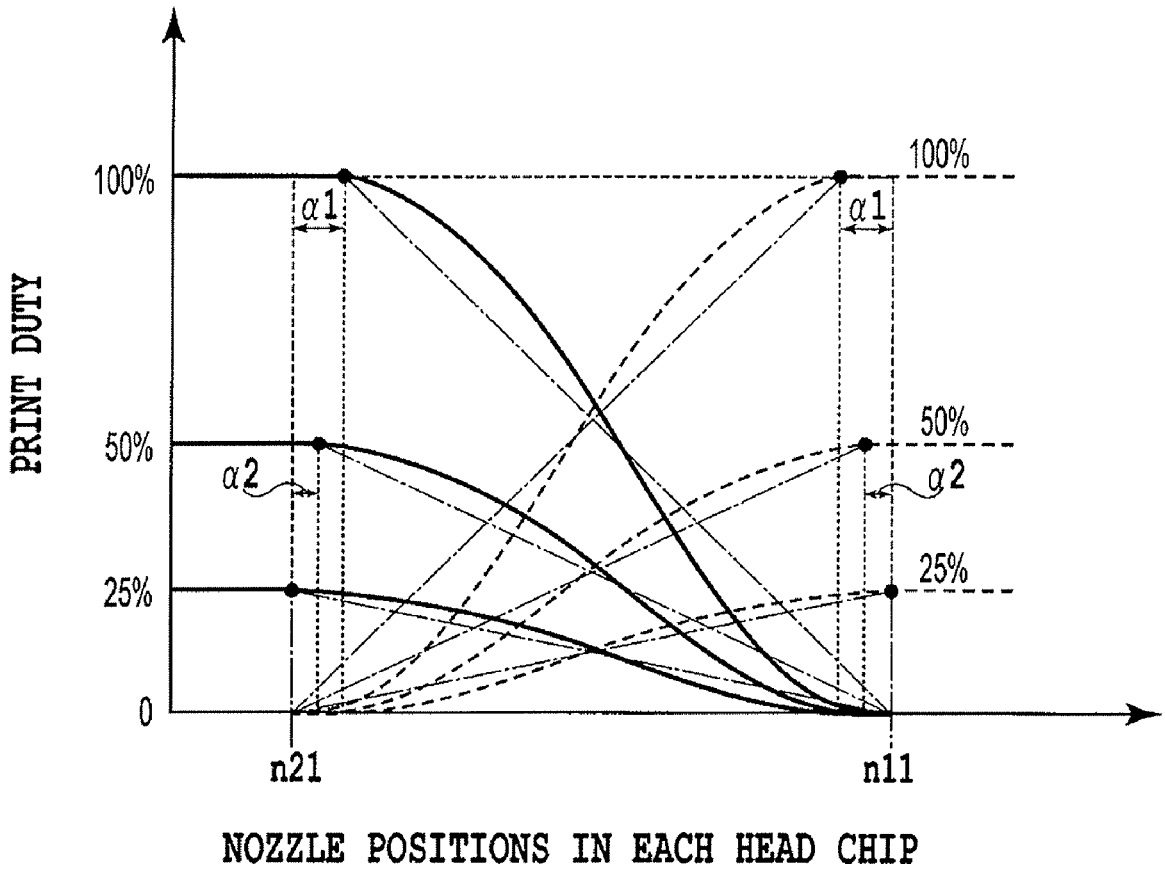
FIG. 8 is a diagram showing an example of print duties set for nozzles at connecting portions between head chips shown in FIG. 7.

FIG. 8 is a diagram showing how print duties are set for the nozzles. In FIG. 8, the axis of abscissa indicates the positions of the nozzles at the connecting portion OP2 between the head chips h1 and h2. The axis of ordinate indicates the print duties set for the nozzle arrays N1 and N2 (set print duties) and for the nozzles by the original image data. In the figure, solid curves indicate print duties set for the nozzles in the head chip h1. Dashed curves indicate print duties (setting print duties) set for the nozzles in the head chip h2. On the axis of abscissa, n11 indicates the position of the terminal nozzle in the head chip h1. n21 indicates the position of the terminal nozzle in the head chip h2. $\alpha 1$ and $\alpha 2$ denote the possible end deviation amounts of the terminal nozzles n11 and n21 in the head chips h1 and h2. $\alpha 1$ denotes an end deviation image data is 100%. $\alpha 2$ denotes an end deviation amount observed when the print duty is 50%.

As shown in FIG. 3, the end deviation amounts of the head chips h1 and h2 vary depending on the print duties set for the nozzle arrays N1 and N2 based on the original data . Thus, a variation in print duty varies the width of the overlapping area on the print sheet S in which dots formed by the head chips h1 and h2 overlap each other. Consequently, a higher original image density allows nozzles closer to the ends of head chips h1 and h2 to form the end of the overlapping area AR1.

For example, in the print head 10 shown in FIG. 7, if end deviation occurs in the head chips h1 and h2, one end e1 of the overlapping area AR1 formed on the print sheet S is formed by the terminal nozzle n11 in the head chip h1 and the end nozzle n23 in the head chip h2. That is, instead of the end nozzle n24, located at the same position as that of the terminal nozzle n11 in the X direction, the end nozzle n23, located closer to the end of the head chip than the end nozzle n24 by the end deviation amount, forms the end e1 of the overlapping area AR1 together with the terminal nozzle n11. Similarly, the other end e2 of the overlapping area AR1 is formed by the terminal nozzle n21 in the head chip h2 and the end nozzle n13 in the head chip h1. The end nozzle n13 is located closer to the end of the head chip h1 than the end nozzle n14 by the end deviation amount; the end nozzle n14 is located at the same position as that of the terminal nozzle n21 in the X direction.

As described above, a higher original image density allows nozzles closer to the ends of head chips to correspond to the end of the overlapping area. Thus, the print duties for the nozzles located at the connecting portion OP2 between the head chips h1 and h2 are set as shown in FIG. 8. That is, with a higher print duty set for the nozzle array by the original image data, the position (hereinafter referred to as a duty decrease start position) of the nozzle at which in the connecting portion OP2, the print duty starts to decrease is moved toward the terminal nozzle in the head chip. Points • in FIG. 8 indicate the duty reduction start positions. As shown in the figure, when the print duty is set, by the original image data, to 100%, instead of the value (25% or less) at which almost no end deviation occurs, the duty decrease start position in each head chip is moved closer to the terminal node n11 or n21 by an end deviation amount $\alpha 1$. At a print duty for 50%, the duty decrease start position in each head chip h1 or h2 is moved closer to the terminal nozzle n11 or n21 by an end deviation amount $\alpha 2$. However, also in this case, the print duties for the nozzles located at the connecting portion OP2 between the head chips h1 and h2 are set so that the sum of print duties for a pair of nozzles from which ink droplets that land on the print sheet at the same position in X direction are ejected is equal to the original image data density. In other words, the print duties are set so that the density in the overlapping area AR1 is equal to the original image data density. Further, the print duties for the nozzles forming the area AR2 in the connecting portion OP2 are set equal to those set by the original image data.

In the present embodiment, as shown by solid and dashed curves in FIG. 8, the print duty decreases gradually from the print duty decrease start position to the end of the nozzle array N1 or N2 in the head chip h1 or h2. This makes it possible to make image connecting portions formed by the head chips h1 and h2 more unnoticeable.

In the third embodiment, to reduce the print duties for the nozzles at the connecting portion OP2 between the head chips h1 and h2 as described above, the image processing section J1000 varies a multivalue signal indicating the original image density. That is, 256-gradations original image data expressed by 8-bit signals is reduced in accordance with the curves shown in FIG. 8. The print data is thus converted, via the half toning process J1005 and the dot arranging pattern J1007, into 1-bit (2-value) signal indicating whether or not form a dot; the print duties for the resulting print data decrease in accordance with the solid curves shown in FIG. 8.

Provided that the print duties provided by the head chips h1 and h2 are added together to obtain the original image data density on the print sheet, the print duties may be set in accordance with an alternate long and short dash line passing through point • or another curve.

Figure 9:
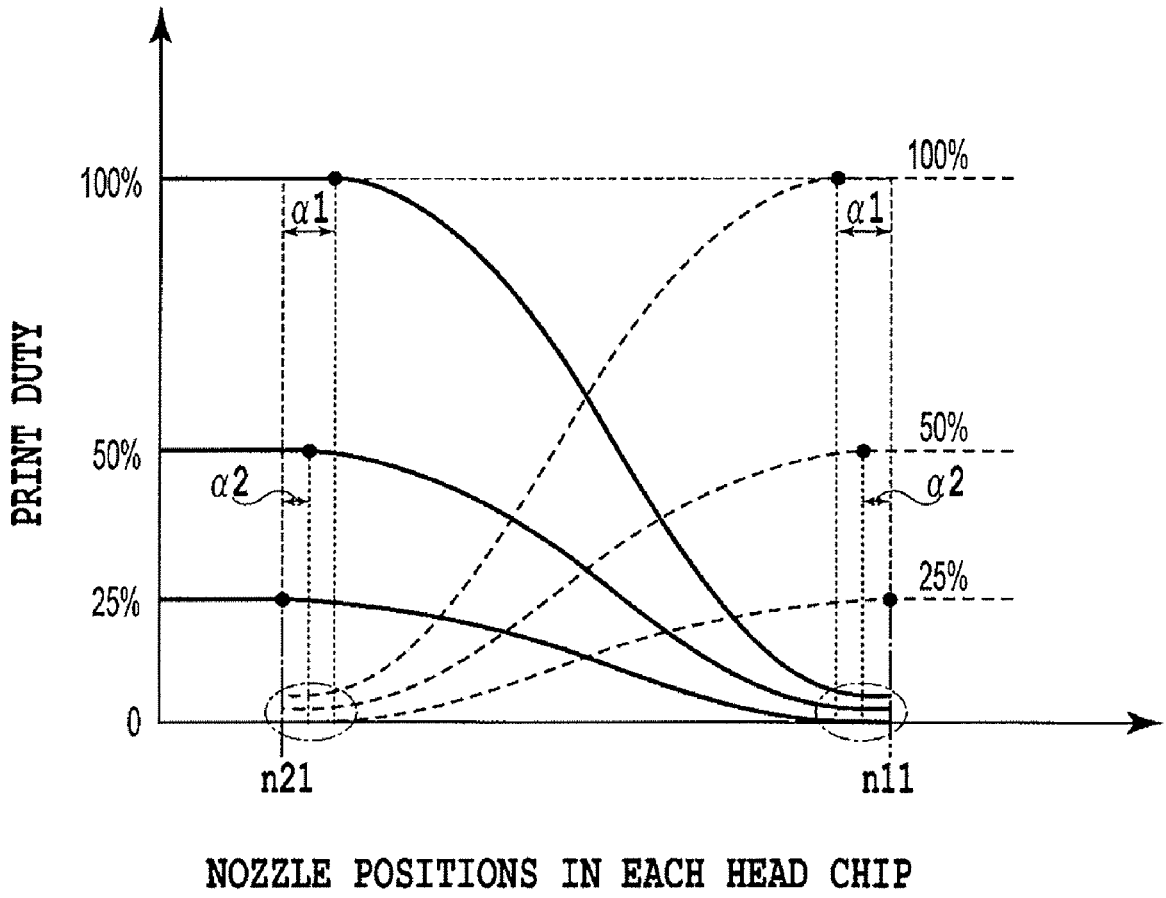
FIG. 9 is a diagram showing another example of print duties set for the nozzles at the connecting portions between the head chips shown in FIG. 7.
Figure 10:
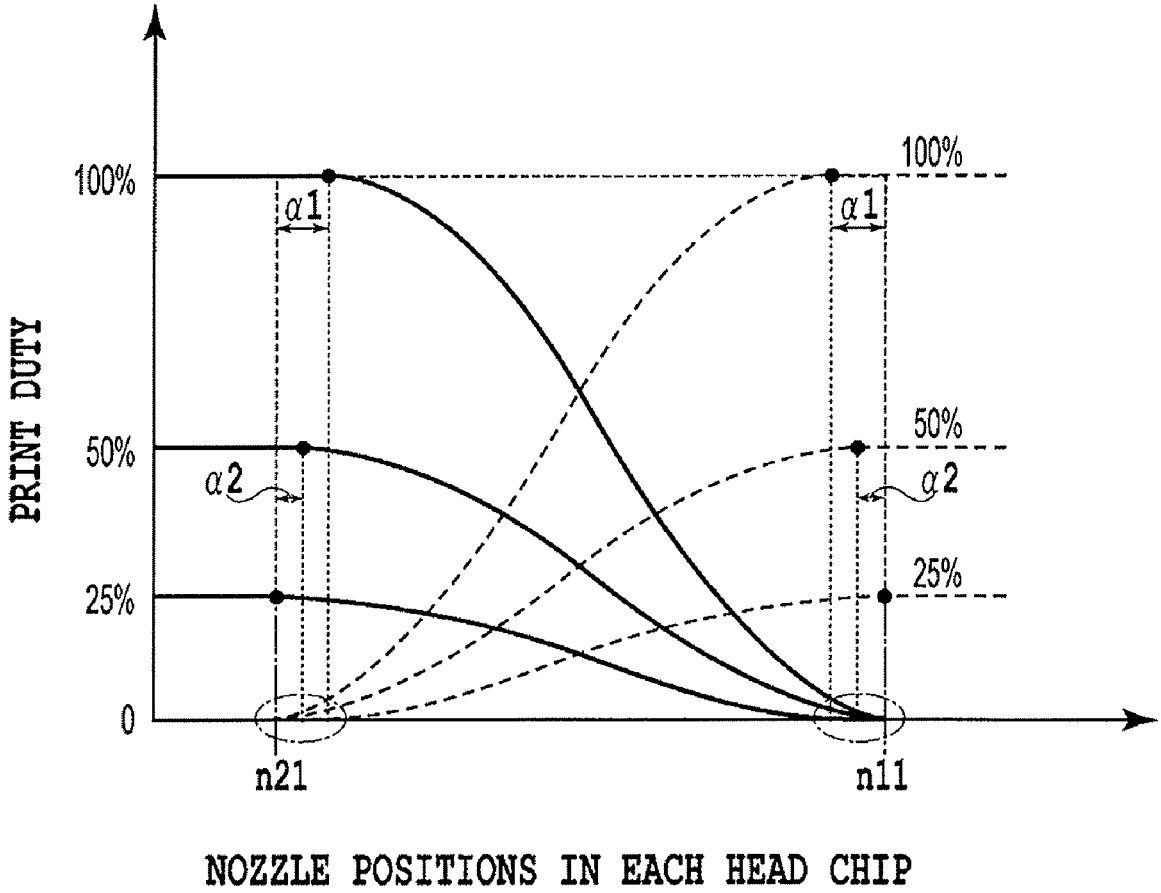
FIG. 10 is a diagram showing another example of print duties set for the nozzles at the connecting portions between the head chips shown in FIG. 7.

The density of the overlapping area AR1 may be increased by the reduced interval (dot interval) between the landing positions on the print sheet S of ink droplets ejected from the nozzles at the connecting portion OP2 between the head chips h1 and h2. It is thus possible to decimate more of the dots forming the overlapping area AR1 or to increase the print duty for an area which is located in the vicinity of the overlapping area AR1 and which is different from the overlapping area AR1, as shown in FIGS. 9 and 10. This enables a rapid change in density to be suppressed.

If the density on the print sheet in the vicinity of the ends of the head chips h1 and h2 is insufficient, the print duties may be set so as to slightly increase the density at the end of the overlapping area as shown in FIGS. 9 and 10. This makes it possible to suppress a rapid change in density at the connecting portion OP2. The density can thus be smoothly varied between the image in the overlapping area and an image connected to this image. Images of a higher quality can therefore be formed.

Fourth Embodiment

With a print head constructed by connecting a plurality of head chips together as shown in the third embodiment, the head chips may offer different ejection amounts resulting in different densities on the print sheet. To cope with this, a fourth embodiment of the present invention executes not only the process of the third embodiment but also the following process. A driving pulse for ahead chip with a larger ejection amount is controlled on the basis of a head chip with the smallest ejection amount so as to reduce the ink ejection amount of the former head chip or to reduce the entire print duty for the former head chip.

Figure 11:
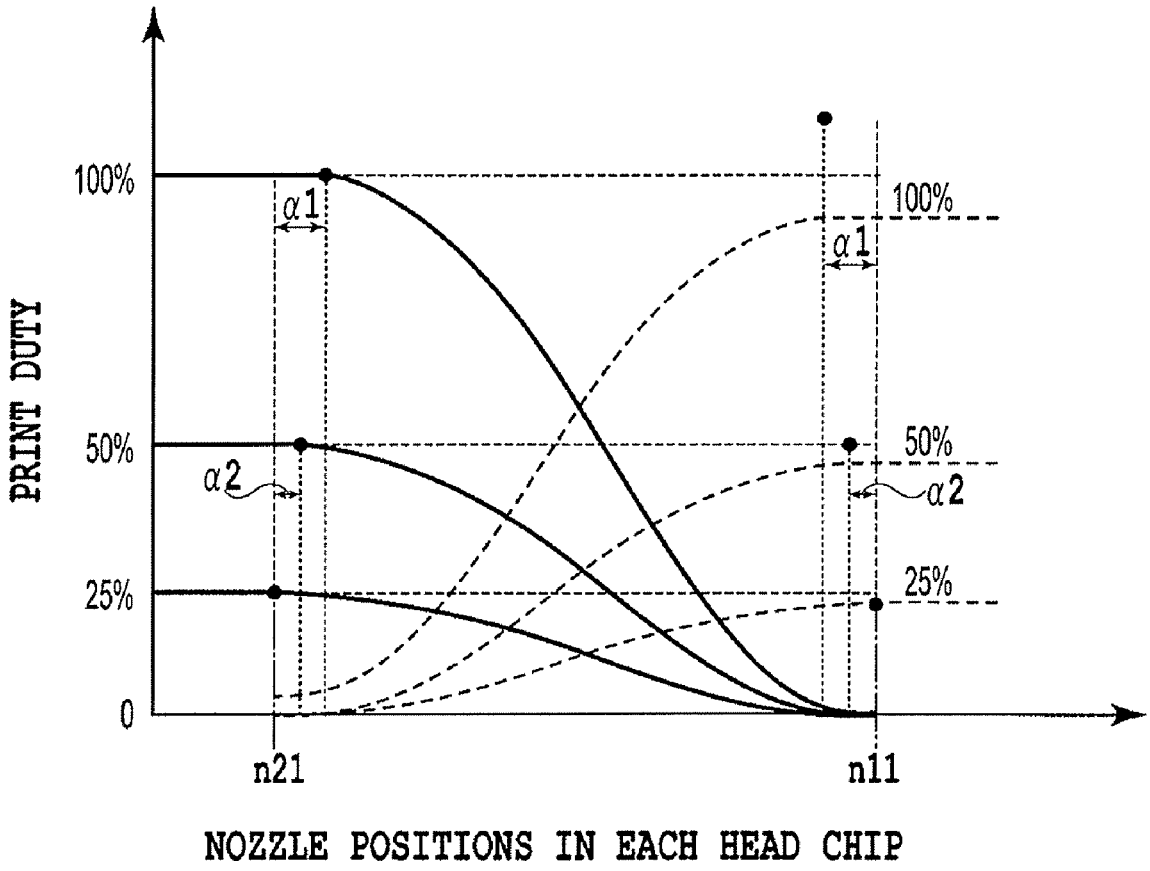
FIG. 11 is a diagram showing another example of print duties set for the nozzles at the connecting portions between the head chips shown in FIG. 7.

For example, as shown in FIG. 11, if the head chip h2 offers a large ejection amount, the entire print duty for the head chip h2 is reduced so that the head chip h2 has the same print density as that of the other head chip. Of course, also in this case, it is possible to increase the print duty for that part of the area formed by the connecting portion area between the head chips in which ink droplets from the head chips do not overlap one another as shown in FIGS. 9 and 10.

Thus, a possible method for changing the print duties is to multiply 8-bit image data expressing 256 gradations by a predetermined ratio to reduce the image data density and then to execute a conversion into binary data indicating whether or not to print dots. Alternatively, after the conversion into binary data, masking may be used to reduce the entire print duty. The conversion into binary data may involve the half toning process J1005 or dot arrangement patterning process, shown in FIG. 5, or the like.

Fifth Embodiment

With a print head constructed by connecting a plurality of head chips together as shown in FIGS. 1, 2, and 7, the extended time during which the ejection of ink droplets is halted is likely to increase the ink density in the vicinity of the terminal nozzle in each head chip. Thus, if ejection is resumed after the ejection halted period, then from the start of the ejection until completion of about several hundred impacts, the density of ink droplets ejected from the end of head chip may be higher than that of subsequently ejected ink droplets. In this case, the optical density of dots formed on the print medium may be uneven. To suppress an increase in optical density, the fifth embodiment extends the position where the print duties for the head chips h1 and h2 start to decrease, to an area other than the connecting portion between the head chips. Also in this case, it is possible to increase the print duty for that part of the area formed by the connecting portion between the head chips in which ink droplets from the head chips do not overlap one another as shown in FIGS. 9 and 10.

Sixth Embodiment

The first to fifth embodiments have been described taking the case of the full line type ink jet printing apparatus that performs a printing operation using the long print head constructed by connecting the plurality of head chips together. However, the present invention is applicable to a serial type ink jet printing apparatus that performs a printing operation using a print head composed of a single head chip, as in the case of a sixth embodiment described below.

Figure 15:
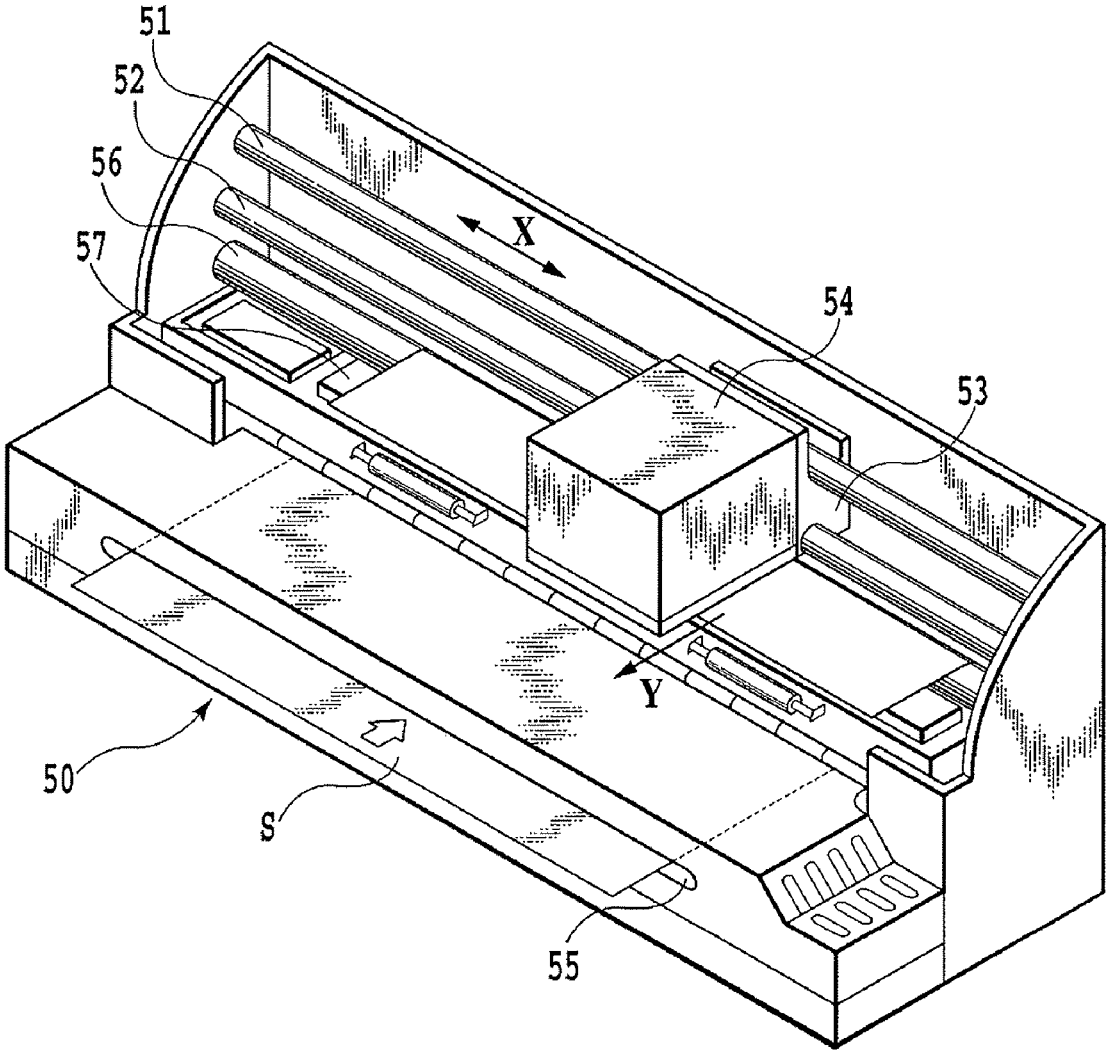
FIG. 15 is a perspective view schematically showing an example of configuration of a mechanism section of a serial type ink jet printing apparatus applied to a sixth embodiment of the present invention.

FIG. 15 is a perspective view schematically showing an example of configuration of a mechanism section of a serial type ink jet printing apparatus applicable to the sixth embodiment.

In the serial type ink jet printing apparatus 50 according to the present embodiment, a carriage 53 is guided via guide shafts 51 and 52 so as to be movable in a main scanning direction shown by arrow X. The carriage 53 is reciprocated in the main scanning direction by a carriage motor and a driving force transmitting mechanism such as a belt which transmits the driving force of the carriage motor. A print head described below and an ink tank 54 are mounted on the carriage 53; the ink tank 54 supplies ink to the print head. The print head and the ink tank 54 may constitute an ink jet cartridge.

A print sheet S as a print medium is first inserted through an insertion port 55 formed at a front end of the apparatus. Then, the print sheet S has its conveying direction reversed and is then conveyed in a sub-scanning direction (X direction) by a feeding roller 56. The printing apparatus 50 repeats a printing operation (main scan) of ejecting ink onto the print sheet S on a platen 57 while moving a print head 20 in a main scanning direction (Y direction) and a conveying direction (sub-scan) of conveying the print sheet S in the sub-scanning direction by a distance corresponding to the print width of the print sheet S. This allows images to be sequentially printed on the print sheet S.

Figure 12:
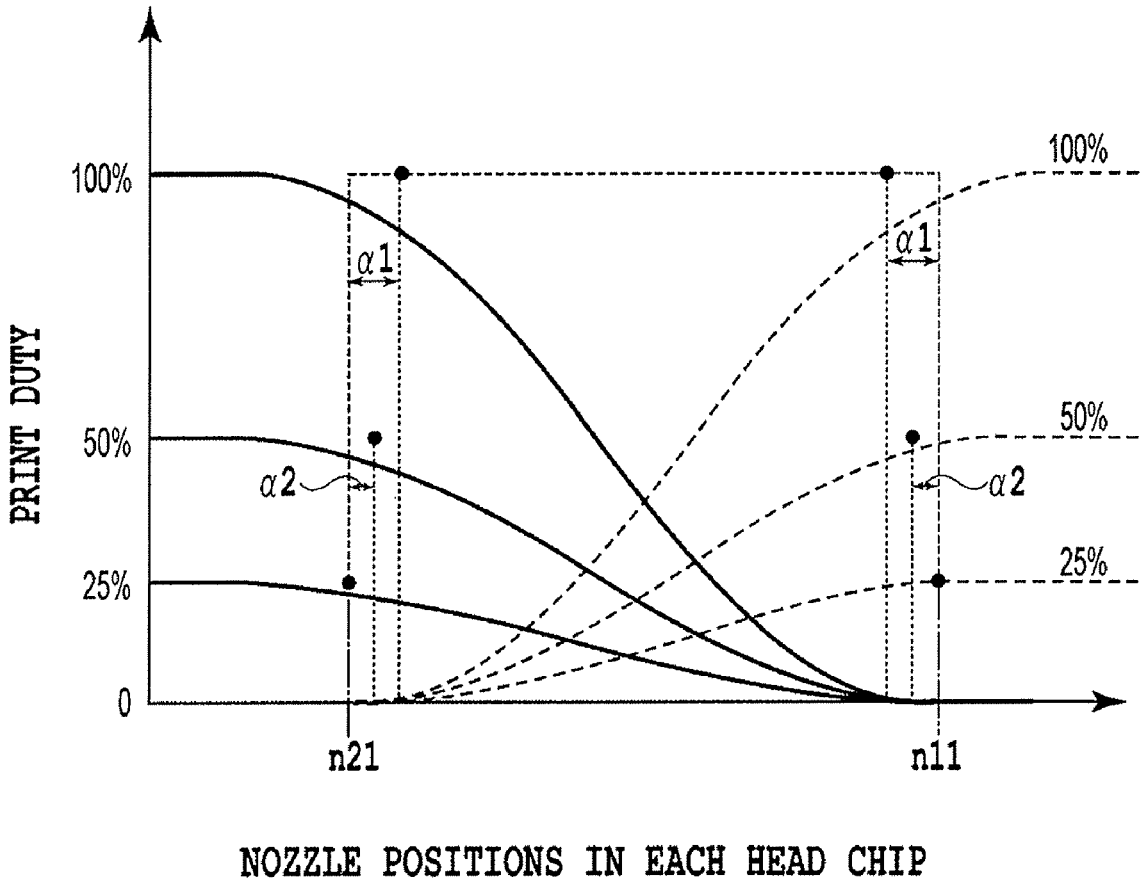
FIG. 12 is a diagram showing another example of print duties set for the nozzles at the connecting portions between the head chips shown in FIG. 7.

The control system of the printing apparatus 50 comprises a CPU, a ROM, and a RAM similar to those in FIG. 12. The control system controls, via a motor driver, a carriage motor for driving the carriage 53 in the main scanning direction and a conveying motor for conveying the print sheet S in the sub-scanning direction. The CPU in the control system has an image processing function for controlling the number of ink droplets (print duty) ejected from the print head 10 as described below. However, these functions of the CPU 100 may be provided in the host apparatus 200.

Some serial type ink jet printing apparatuses 50 may perform both one-pass printing and multipass printing, described in the related art section. In a common one-pass printing operation, after a main print scan of the print head 20, the print sheet S is conveyed by the same width as that (length in the nozzle arranging direction) of a nozzle array in the print head 20. The ends of images formed during respective print scans are joined together to form an image for one page. However, even with the serial type ink jet printing apparatus, end deviation may occur at an end of the print head 20 to cause white stripes at connecting portions between images printed by respective main scans. The sixth embodiment thus overlaps the ends of images printed by respective main scans on top of one another to reduce possible white stripes caused by end deviation.

Figure 16:
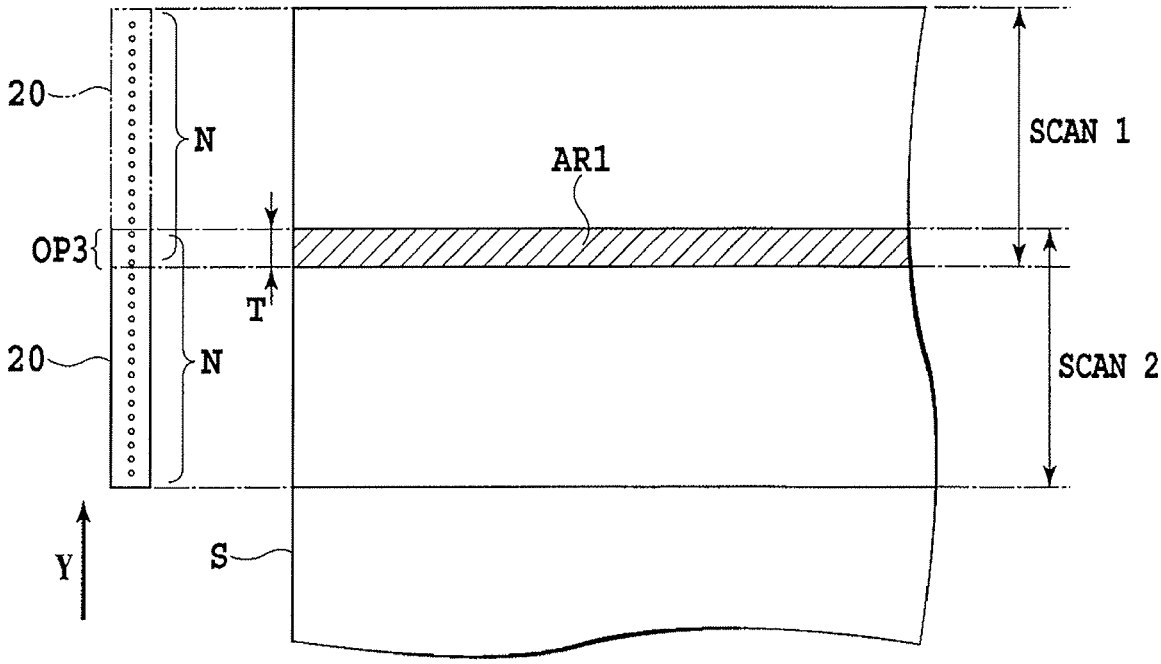
FIG. 16 is an explanatory diagram showing the range of a main scan executed by a print head according to the sixth embodiment of the present invention.

That is, as shown in FIG. 16, the front end of the nozzle array (N) passes, during a certain main scan (scan 2), over an area (shaded area in the figure) over which the rear end of the nozzle array N passed during the last main scan (scan 1). This printing scheme can be achieved by setting the conveying amount of the print sheet S smaller than the width of the nozzle array in the print head 20.

During each scan, if no end deviation occurs at the end of the nozzle array N, the width T of a connecting portion OP3 of the nozzle array N which passes over the same area of the print sheets twice is equal to the width W of an overlapping area AR1 of an image formed on the print sheet S. The print duties for the nozzles located at the connecting portion OP3 are set so that the density of the overlapping area AR1 is equal to that set by the original image data after two scans.

Figure 17:
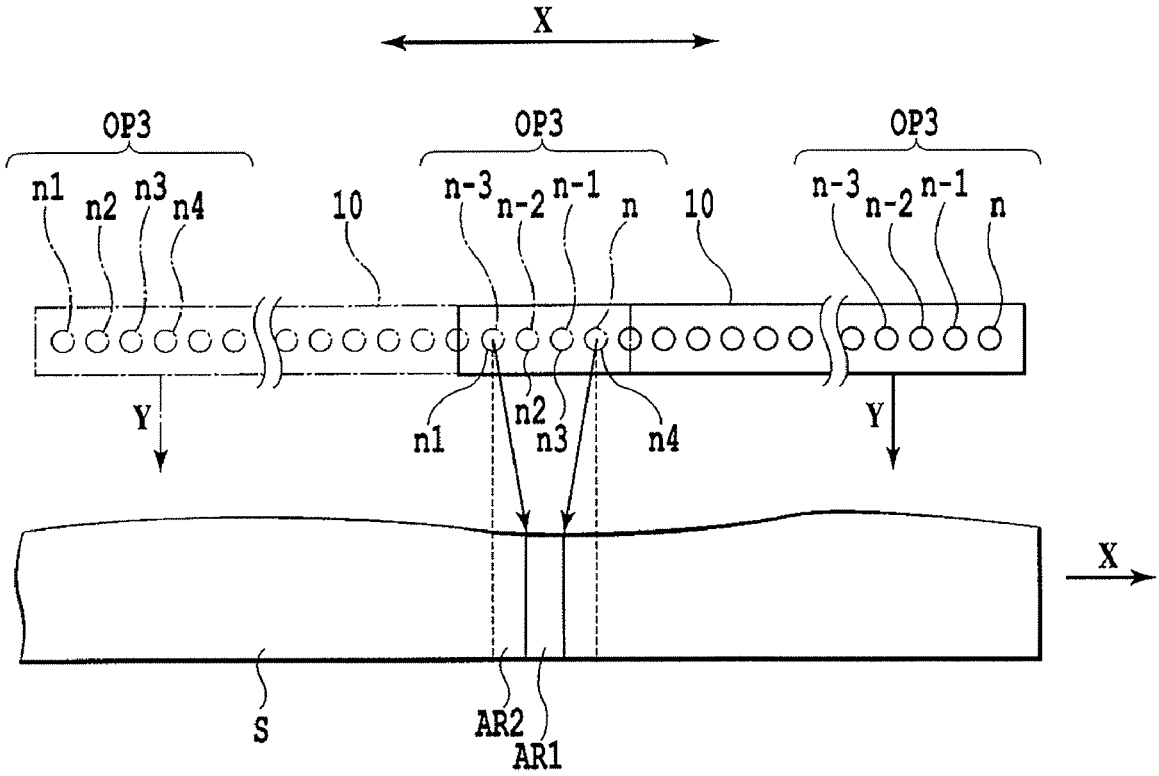
FIG. 17 is a diagram illustrating the print head used in the sixth embodiment of the present invention and the range of landing positions of ink droplets ejected from the print head.

If end deviation occurs at the terminal nozzle in the print head 20 during a printing operation, the width of the image overlapping area AR1 decreases as shown in FIG. 17. This phenomenon is similar to that described in the fourth embodiment, shown in FIG. 7. That is, the position of the nozzle array N during the last main scan, shown by an alternate one and short dash line in FIG. 17, corresponds to the position of the nozzle array in the head chip h1, shown in FIG. 7. The position of the nozzle array N during the current main scan, shown by a solid line in FIG. 17, corresponds to the position of the nozzle array in the head chip h2, shown in FIG. 7. The connecting portion OP3, shown in FIG. 17, corresponds to the connecting portion OP2, shown in FIG. 2. Nozzles n1 to n4 in FIG. 17 correspond to the nozzles n21 to n24 in FIG. 7. Nozzles n to n3 in FIG. 17 correspond to the nozzles n11 to n14 in FIG. 7.

Accordingly, also in the sixth embodiment, a higher original image density sets the range of nozzles forming the overlapping area AR1 closer to the end of the nozzle array N. Thus, as shown in FIGS. 8 to 12, the print duties for the nozzles located in the connecting portion are varied depending on the end deviation amount. Thus, even if the serial type ink jet printing apparatus is used to execute one-pass printing, possible white or black stripes caused by end deviation can be prevented. High quality images can thus be obtained.

The sixth embodiment has been described taking the case where the ends of images formed during respective scans for on-pass printing are overlapped one another. However, the sixth embodiment is also applicable to the multipass printing, in which an image that is formed in the same print area is completed by a plurality of scans. The present invention is particularly effective on printing operations with few passes such as two passes.

The above embodiments can inhibit possible density unevenness caused by the end deviation condition when a long print head constructed by connecting together a plurality of head chips which eject smaller droplets and which have a high nozzle density or when low-pass printing is executed while overlapping the ends of images on top of one another. The embodiments can also achieve the optimum density correction in real-time on the basis of data indicating the densities of images. This makes it possible to inhibit possible density unevenness at connecting portions between images while maintaining a high throughput, at every gradation ranging from low density to high density. Therefore, even if a pictorial color image for which the reproducibility of gradations is important is formed by combining a plurality of colors on one another, a high quality image can be formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-380068, filed Dec. 28, 2005, which is hereby incorporated by reference herein in its entirety.

What is claimed is:

1. An ink jet printing apparatus which executes printing by executing a scanning of a print medium, the apparatus comprising:

a print head having a plurality of nozzle chips which are arranged in staggered positions and having a nozzle array in which a plurality of ink ejecting nozzles are arranged, the nozzle chips being arranged in different positions along a nozzle arranging direction; and print duty setting means for setting a print duty for a nozzle located at an end of the nozzle array of each of the plurality of the nozzle chips on the basis of an end deviation amount, which is a variation amount of a landing position of an ink droplet ejected from the end of the nozzle array, wherein the plurality of the nozzle chips includes a connecting portion in which a portion of an area in which the plurality of nozzles are arranged in one of the nozzle chips overlaps with a portion of an area in which the plurality of nozzles are arranged in an adjacent nozzle chip, and wherein the connecting portion corresponds to a plurality of nozzles located at the ends of the one nozzle chip and the adjacent nozzle chip.

2. The ink jet printing apparatus according to claim 1, wherein the print duty setting means reduces the print duties, for those of the plurality of nozzles located at the connecting portion between the nozzle arrays which are selected on the basis of the end deviation amount, below a set print duty set by original image data indicating a density of the image to be printed.

3. The ink jet printing apparatus according to claim 2, wherein the print duty setting means sets the print duty for a nozzle that forms, on the print medium, an image area in which dots formed by ink droplets ejected from the one nozzle chip are mixed with dots formed by ink droplets ejected from the adjacent nozzle chip.

4. The ink jet printing apparatus according to claim 2, wherein the print duty setting means reduces the print duties for the nozzles at the connecting portion between the nozzle chips depending on a distance from a terminal nozzle in each of the nozzle chips.

5. The ink jet printing apparatus according to claim 1, wherein the print duty setting means integrates a process of subjecting original image data to gamma correction on the basis of a relationship between the amount of ink ejected to a given area and optical density and a process of reducing the print duties for the nozzles located at the connecting portion.

6. The ink jet printing apparatus according to claim 1, wherein the print duty setting means determines the number of ink ejections provided until the image formed on the print medium by the ends of adjacent nozzle chips exhibits a uniform optical density along the entirety of the nozzle arrays, on the basis of a time during which a printing operation is halted, and reduces the print duties for the ends and nearby portions of the nozzle chips from a start of the printing operation until the determined ink ejection number is reached.

7. An ink jet printing apparatus which executes printing by executing scanning of a print head relative to a print medium, the print head having a nozzle array in which a plurality of ink ejecting nozzles are arranged, the apparatus comprising:

print duty setting means for setting a print duty for a nozzle located at an end of the nozzle array on the basis of an end deviation amount corresponding to an error in a landing position of an ink droplet ejected from the end of the nozzle array, wherein the print duty setting means changes the print duty for each of the nozzles at a connecting portion in accordance with an ink ejection state of the nozzles at the connecting portion, the connecting portion being an area of the nozzle array that overlaps with another nozzle array.

8. An ink jet printing apparatus, which executes printing by executing scanning of a print head relative to a print medium, the print head having a nozzle array in which a plurality of ink ejecting nozzles are arranged, the apparatus comprising:

print duty setting means for setting a print duty for a nozzle located at an end of the nozzle array on the basis of an end deviation amount corresponding to an error in a landing position of an ink droplet ejected from the end of the nozzle array, wherein if images formed on the print medium by adjacent nozzle arrays have different optical densities, the print duty setting means reduces the print duty for the nozzle array with the higher optical density so that the images printed by the nozzle arrays have a uniform optical density.

9. An ink jet printing apparatus which executes printing by executing scanning of a print head relative to a print medium, the print head having a nozzle array in which a plurality of ink ejecting nozzles are arranged, the apparatus comprising:

print duty setting means for setting a print duty for a nozzle located at an end of the nozzle array on the basis of an end deviation amount corresponding to an error in a landing position of an ink droplet ejected from the end of the nozzle array, wherein if an image formed on the print medium by the ends of adjacent nozzle arrays after a halt of the printing has an optical density higher than a density indicated by original image data, the print duty setting means reduces the print duties for the ends and nearby portions of the nozzle arrays until the image formed on the print medium by the ends of the adjacent nozzle arrays exhibits a uniform optical density along the entirety of the nozzle arrays.

10. An ink jet printing apparatus which executes printing by executing scanning of a print head relative to a print medium, the print head having a nozzle array in which a plurality of ink ejecting nozzles are arranged, the apparatus comprising:

print duty setting means for setting a print duty for a nozzle located at an end of the nozzle array on the basis of an end deviation amount corresponding to an error in a landing position of an ink droplet ejected from the end of the nozzle array, wherein the print head comprises head chips having nozzle arrays, in each of which a plurality of nozzles capable of ejecting ink are disposed, the head chips being arranged over a width equal to or larger than the maximum width of the print medium to which the arrangement is applicable, and printing is executed by moving the print head and the print medium relative to each other only in a given direction.

11. An ink jet printing apparatus which executes printing by executing scanning of a print head relative to a print medium, the print head having a nozzle array in which a plurality of ink ejecting nozzles are arranged, the apparatus comprising:

print duty setting means for setting a print duty for a nozzle located at an end of the nozzle array on the basis of an end deviation amount corresponding to an error in a landing position of an ink droplet ejected from the end of the nozzle array, wherein the print head has a single nozzle array in which a plurality of nozzles capable of ejecting ink are arranged, and a sub-scan that moves the print medium relative to the print head and a main scan that scans the print head along a direction crossing the moving direction of the print medium are repeated to execute scanning such that the end of the nozzle array passes over the same position on the print medium a number of times.

12. A method for ink jet printing which executes printing by executing scanning of a print head relative to a print medium, the print head having a plurality of nozzle chips which are arranged in staggered positions and each having a nozzle array in which a plurality of ink ejecting nozzles are arranged, the nozzle chips being arranged in different positions along a nozzle arranging direction, the method comprising the step of:

setting a print duty for a nozzle located at an end of the nozzle array of each of the plurality of the nozzle chips on the basis of end deviation amount, which is a variation amount of a landing position of an ink droplet ejected from the end of the nozzle array, wherein the plurality of the nozzle chips includes a connecting portion in which a portion of an area in which the plurality of nozzles are arranged in one of the nozzle chips overlaps with a portion of an area in which the plurality of nozzles are arranged in an adjacent nozzle chip, and wherein the connecting portion corresponds to a plurality of nozzles located at the ends of the one nozzle chip and the adjacent nozzle chip.

* * * * *